US011659345B2

(12) United States Patent
Popescu-Stroe et al.

(10) Patent No.: US 11,659,345 B2
(45) Date of Patent: May 23, 2023

(54) METHODS FOR TRANSMITTING NON-ACOUSTIC DATA BETWEEN A MICROPHONE AND A CONTROLLER

(71) Applicant: Infineon Technologies AG, Neubiberg (DE)

(72) Inventors: Victor Popescu-Stroe, Bucharest (RO); Matthias Boehm, Putzbrunn (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 17/518,108

(22) Filed: Nov. 3, 2021

(65) Prior Publication Data

US 2022/0174440 A1 Jun. 2, 2022

(30) Foreign Application Priority Data

Nov. 27, 2020 (DE) ..... 102020131502.3

(51) Int. Cl.

| | |
|---|---|
| ***H04R 29/00*** | (2006.01) |
| ***H04R 1/04*** | (2006.01) |
| ***H04R 1/08*** | (2006.01) |
| ***H04R 3/00*** | (2006.01) |

(52) U.S. Cl.

CPC ..... *H04R 29/004* (2013.01); *H04R 1/04* (2013.01); *H04R 1/08* (2013.01); *H04R 3/005* (2013.01); *H04R 2420/09* (2013.01)

(58) Field of Classification Search

CPC ..... H04R 29/004; H04R 1/04; H04R 1/08; H04R 3/005; H04R 2420/09

USPC ..... 381/10, 56, 58, 80, 123

See application file for complete search history.

(56) References Cited

U.S. PATENT DOCUMENTS

| | | | | |
|---|---|---|---|---|
| 2005/0100174 | A1* | 5/2005 | Howard | H04R 5/04 381/86 |
| 2006/0071768 | A1* | 4/2006 | Iwazumi | B60C 23/0442 340/447 |
| 2012/0014531 | A1 | 1/2012 | Yamkovoy | |
| 2013/0058495 | A1* | 3/2013 | Furst | H04R 3/00 381/80 |
| 2013/0219204 | A1* | 8/2013 | Chen | H04M 1/738 713/323 |
| 2016/0105750 | A1 | 4/2016 | Cagdaser et al. | |
| 2016/0165333 | A1* | 6/2016 | Gokingco | A61B 5/024 381/74 |
| 2017/0308352 | A1* | 10/2017 | Kessler | H04R 3/005 |
| 2019/0149933 | A1* | 5/2019 | Chun | H04R 1/1041 381/58 |
| 2020/0329325 | A1* | 10/2020 | Thukral | H04R 19/04 |

FOREIGN PATENT DOCUMENTS

DE 112012003663 T5 6/2014

* cited by examiner

*Primary Examiner* — William A Jerez Lora
(74) *Attorney, Agent, or Firm* — Harrity & Harrity, LLP

(57) ABSTRACT

A method includes providing a first data channel configured for a transmission of acoustic data between a first microphone and a controller, providing a second data channel configured for a transmission of acoustic data between a second microphone and the controller, and transmitting non-acoustic data generated by the first microphone via the second data channel.

22 Claims, 4 Drawing Sheets

METHODS FOR TRANSMITTING NON-ACOUSTIC DATA BETWEEN A MICROPHONE AND A CONTROLLER

RELATED APPLICATION

This application claims priority to German Patent Application No. 102020131502.3, filed on Nov. 27, 2020, which is incorporated herein by reference in its entirety.

FIELD

The present disclosure relates to methods for transmitting non-acoustic data between a microphone and a controller. In addition, the present disclosure relates to devices for performing such methods.

BACKGROUND

Microphone sensors may include one or multiple digital microphones communicating with a controller. For safety critical applications, such as e.g., some types of automotive microphone sensors, it may be of interest to report occurring malfunctions of the microphones to the controller. Conventional digital microphones used in the consumer market do not necessarily include or require technical features providing a transmission of such diagnostic data. Manufacturers of microphone devices are constantly striving to improve their products and methods for operating thereof. In particular, it may be desirable to provide devices and methods providing improved security features.

SUMMARY

An aspect of the present disclosure relates to a method. The method includes providing a first data channel configured for a transmission of acoustic data between a first microphone and a controller. The method further includes providing a second data channel configured for a transmission of acoustic data between a second microphone and the controller. The method further includes transmitting non-acoustic data generated by the first microphone via the second data channel.

An aspect of the present disclosure relates to a method. The method includes initiating a start-up phase of a microphone. The method further includes providing a data channel configured for a transmission of acoustic data between the microphone and a controller. The method further includes, during the start-up phase and before transmitting acoustic data via the data channel, transmitting non-acoustic data via the data channel.

An aspect of the present disclosure relates to a method. The method includes providing a data channel configured for a transmission of acoustic data between a microphone and a controller. The method further includes transmitting a data signal generated by the microphone via the data channel, wherein the data signal includes acoustic data and non-acoustic data.

An aspect of the present disclosure relates to a method. The method includes transmitting acoustic data between a microphone and a controller based on a PDM interface. The method further includes transmitting non-acoustic data generated by the microphone from a channel select pin of the microphone to the controller.

BRIEF DESCRIPTION OF THE DRAWINGS

Methods and devices in accordance with the disclosure will be explained in more detail below based on the drawings. Like reference signs may designate corresponding similar parts.

DETAILED DESCRIPTION

Figure 1:
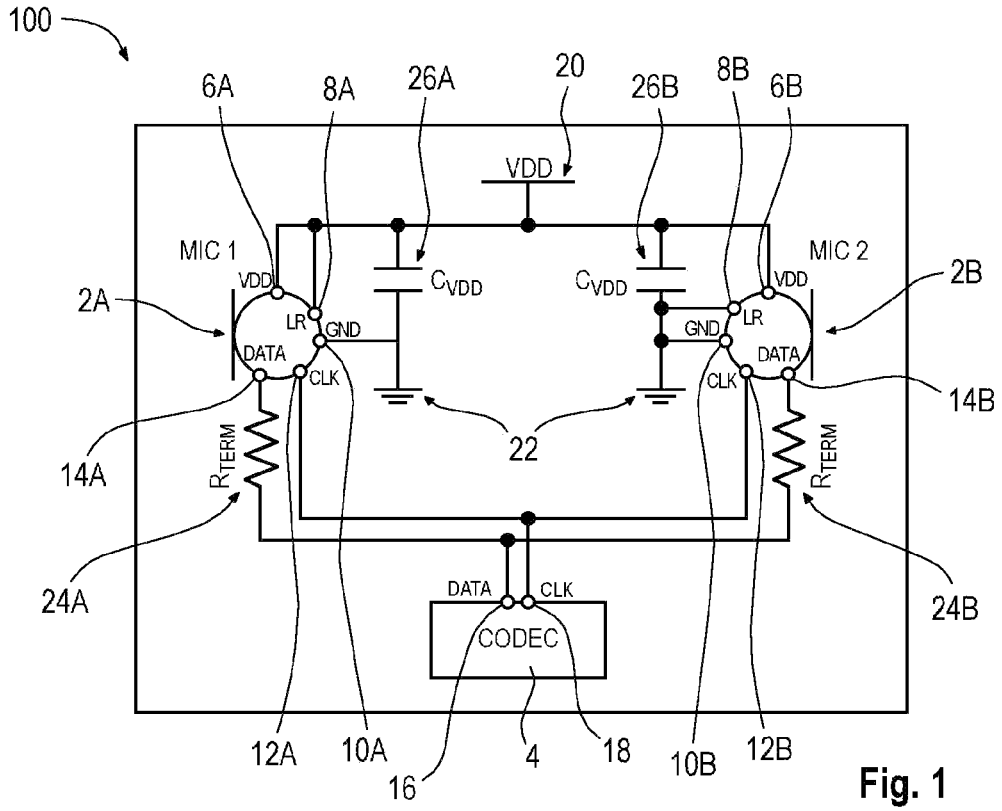
FIG. 1 schematically illustrates a device including two microphones and a controller in accordance with one or more embodiments.

The drawings schematically illustrate methods and devices in a general manner in order to qualitatively specify aspects of the disclosure. It is understood that the methods and devices may include further aspects which are not illustrated for the sake of simplicity. For example, each of the methods and devices may be extended by any of the aspects described in connection with other methods and devices in accordance with the disclosure.

Methods and devices for performing these methods are described herein. Comments made in connection with a described method may also hold true for a corresponding device and vice versa. For example, if a specific act of a method is described, a corresponding device for performing the method may include a component for performing the method act in a suitable manner, even if such component may be not explicitly described or illustrated in the drawings.

The device 100 of FIG. 1 may include a first microphone 2A (see MIC 1), a second microphone 2B (see MIC 2) and a controller 4 (see CODEC). The microphones 2A and 2B may include any type of suitable digital pressure sensor or digital pressure transducer. In particular, the microphones 2A and 2B may correspond to Micro Electro Mechanical Systems (MEMS) microphones. For example, the microphones 2A and 2B may be manufactured from a semiconductor material, such as e.g., silicon. The controller 4 may also be referred to as host device. For example, the controller 4 may include at least one of an Electronic Control Unit (ECU), an Electronic Control Module (ECM), a digital signal processor, etc. In the example of FIG. 1, each of the microphones 2A and 2B may include five terminals (or pins) 6 to 14, and the controller 6 may include two terminals 16 and 18. It is understood that each of the microphones 2A, 2B and the controller 4 may include further pins which are not discussed herein for the sake of simplicity.

A first pin 6A of the first microphone 2A may be connected to a supply voltage 20 (see VDD). A second pin 8A of the first microphone 2A may correspond to a channel select pin, such as e.g., an LR (Left/Right) pin (see LR). In the example of FIG. 1, the channel select pin 8A of the first microphone 2A may be connected to the supply voltage 20. A third pin 10A of the first microphone 2A may be connected to a ground potential 22. A fourth pin 12A of the first microphone 2A may correspond to a clock pin which may be connected to a clock pin 18 of the controller 4. A fifth pin 14A of the first microphone 2A may correspond to a data pin which may be connected to a data pin 16 of the controller 4. The pins 6B, 10B, 12B and 14B of the second microphone 2B may be similar to the corresponding pins of the first microphone 2A and may be connected in a similar fashion. In contrast to the first microphone 2A, the channel select pin 8B of the second microphone 2B may be connected to the ground potential 22.

The device 100 may further include a first resistor 24A and a second resistor 24B (see $R_{TERM}$). The first resistor 24A may be connected between the data pin 14A of the first microphone 2A and the data pin 16 of the controller 4, and the second resistor 24B may be connected between the data pin 14B of the second microphone 2B and the data pin 16 of the controller 4. In addition, the device 100 may include a first capacitor 26A and a second capacitor 26B (see $C_{VDD}$). The first capacitor 26A may be connected between the third pin 10A of the first microphone 2A and the supply voltage 20, and the second capacitor 26B may be connected between the third pin 10B of the second microphone 2B and the supply voltage 20.

The microphones 2A and 2B may be configured to sense incoming sound (or pressure) signals and convert these sensed signals to acoustic (or audio) data, in particular digital acoustic data. The digital acoustic data may be transmitted from the microphones 2A and 2B to the controller 4 based on a suitable interface, such as e.g., a Pulse Density Modulation (PDM) interface or an $I^2S$ (Inter-IC Sound) interface. A PDM interface may be a 1-bit interface which may not require having a decimator in the microphones, resulting in reduced chip area, cost and current consumption in the microphones. A delay caused by an analog-to-digital conversion may be comparatively small in PDM microphones. A PDM interface may be based on two interface signals: Clock and Data. The channel select pins 8A and 8B may enable using the two microphones 2A and 2B in a same data line by connecting the channel select pins 8A and 8B to either the supply voltage 20 or the ground potential 22 as exemplarily shown in FIG. 1.

Figure 2:
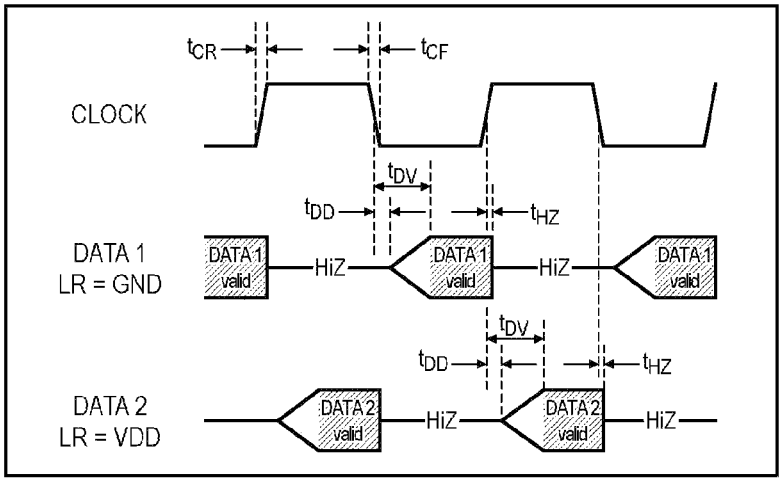
FIG. 2 illustrates a timing diagram for two data channels for transmitting acoustic data between two microphones and a controller in accordance with one or more embodiments.

A possible transmission of acoustic data between the microphones 2A, 2B and the controller 4 is specified in connection with FIG. 2. The controller 4 may be configured to provide a clock signal (see CLOCK) to each of the microphones 2A and 2B. A data communication between the microphones 2A, 2B and the controller 4 may be based on such clock signal. For example, a PDM clock frequency may be in a range from about 0.35 MHz to about 3.3 MHz. During each clock cycle the clock signal may provide a rising edge and a falling edge. The clock signal may rise to a clock high during a clock rise time $t_{CR}$ which may be in a range from about 11 nanoseconds to about 15 nanoseconds, more particular from about 12 nanoseconds to about 14 nanoseconds in one example. The clock signal may fall to a clock low during a clock fall time $t_{CF}$ which may be similar to the clock rise time $t_{CR}$.

A transmission of acoustic data between the microphones 2A, 2B and the controller 4 may be based on channel multiplexing, such as e.g., an LR (Left/Right) channel multiplexing, which may be performed by using the rising clock signal edges and the falling clock signal edges to drive the two microphones 2A and 2B. This way, a first data channel configured for a transmission of acoustic data between the first microphone 2A and the controller 4 as well as a second data channel configured for a transmission of acoustic data between the second microphone 2B and the controller 4 may be provided.

The multiplexing may work such that at each clock edge one of the microphones 2A and 2B is transmitting and the other microphone is in a high-impedance state HiZ. A first data channel may be based on a rising edge of the clock signal. For example, at a rising edge of the clock signal, the second data channel DATA 2 may write data onto the data line and the first data channel DATA 1 may go into the high-impedance state HiZ. In a similar fashion, the first data channel DATA 1 may be based on the falling edge of the clock signal. That is, at the falling edge of the clock signal, the first data channel DATA 1 may write data while the second data channel DATA 2 may go into a high-impedance state HiZ. When in the high-impedance state HiZ, the respective microphone may be electrically invisible to the output data line. This may allow each of the microphones 2A and 2B to drive the contents of the data line while the respective other microphone may be in the high-impedance state HiZ and may wait quietly for its turn. Note that in this regard data of the first data channel DATA 1 and data of the second data channel DATA 2 may be transmitted via a same data line, in particular a wired-or data line.

Several delay times may occur during a data transmission via the two data channels DATA 1 and DATA 2 as exemplarily shown in FIG. 2. A time $t_{DD}$ may correspond to a delay time from when the clock edge is at 50% of the supply voltage (i.e., 0.5×VDD) to when data is driven on the data line. Further, a time $t_{DV}$ may correspond to a delay time from when the clock edge is at 0.5×VDD to when the data driven by the respective microphone on the respective data channel line is valid (i.e., accurately readable). In addition, a time $t_{HZ}$ may correspond to a delay time from when the clock edge is at 0.5×VDD to when the data output of the respective microphone switches into the high impedance state HiZ. In the high-impedance state HiZ the microphone may allow the other microphone to drive the data line.

Figure 3:
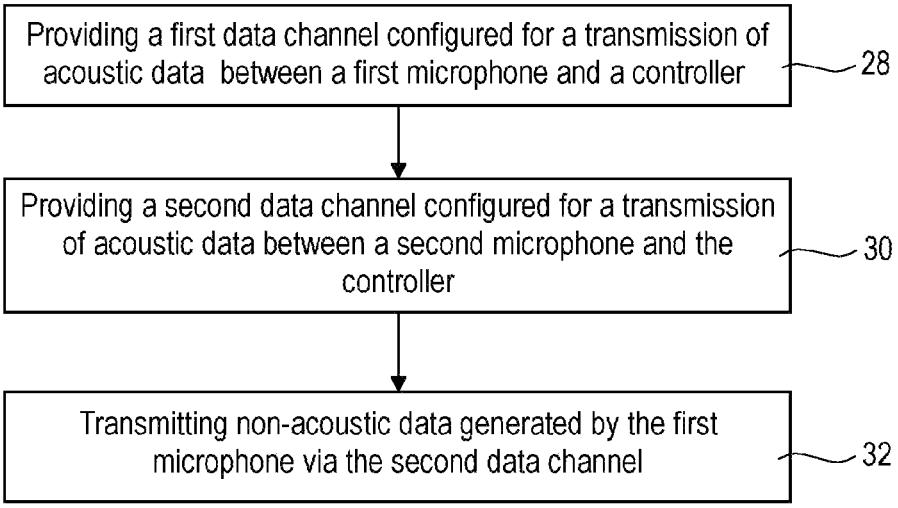
FIG. 3 illustrates a flowchart of a method in accordance with one or more embodiments.

The method of FIG. 3 is specified in a general manner in order to qualitatively specify aspects of the disclosure. The method may be extended by any of the aspects described in connection with the foregoing drawings. At 28, a first data channel configured for a transmission of acoustic data between a first microphone and a controller may be provided. At 30, a second data channel configured for a transmission of acoustic data between a second microphone and the controller may be provided. At 32, non-acoustic data generated by the first microphone may be transmitted via the second data channel. For example, the method of FIG. 3 may be performed by corresponding components of the device 100 of FIG. 1.

Figure 4:
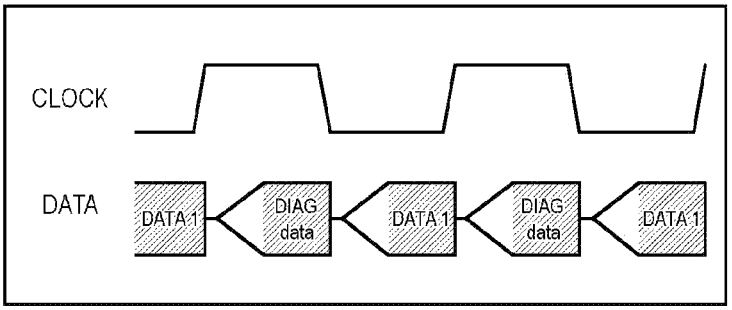
FIG. 4 illustrates a timing diagram for a data channel for transmitting acoustic data and non-acoustic data between a microphone and a controller in accordance with one or more embodiments.

FIG. 4 illustrates a timing diagram for a data channel for transmitting acoustic data and non-acoustic data between one of the microphones 2A, 2B and the controller 4. In the following, reference is only made to an exemplary data transmission between the first microphone 2A and the controller 4. The timing diagram may be read in connection with previously described drawings, in particular with the method of FIG. 3.

A first data channel and a second data channel may have been provided as discussed in connection with FIG. 2. Acoustic data generated by the first microphone 2A may be transmitted from the first microphone 2A to the controller 4 via the first channel (see DATA 1). In addition, non-acoustic data generated by the first microphone 2A may be transmitted from the first microphone 2A to the controller 4 via the second channel (see DIAG data). That is, instead of using the second data channel (see DATA 2 in FIG. 2) for a transmission of acoustic data between the second microphone 2B and the controller, the second data channel is used for transmitting the non-acoustic data of the first microphone 2A.

Non-acoustic data as specified herein may include any kind of data having a frequency outside of the audible frequency range. In this regard, a frequency of the non-acoustic data may be smaller than about 100 Hz, more particular smaller than about 60 Hz, and even more particular smaller than about 20 Hz. Alternatively, or additionally, a frequency of the non-acoustic data may be higher than about 8 kHz, more particular higher than about 16 kHz, and even more particular higher than about 20 kHz. The non-acoustic data may include non-random data.

In general, the non-acoustic data may be transmitted from the first microphone 2A to the controller 4 during an operation or during a start-up phase of the first microphone 2A. During an operation, the non-acoustic data may be transmitted on a periodic basis, for example in periodic time intervals having a length from about 10 milliseconds to about 5 seconds, more particular from about 100 milliseconds to about 1 second.

In one example, the non-acoustic data may include diagnostic data of the first microphone 2A. Diagnostic data of a microphone may include information on at least one of an electronic defect of the microphone or a mechanical defect of the microphone. Electronic and mechanical defects may e.g., be detected based on a microphone chip production self-test. An electronic defect may e.g., include at least one of electrostatic discharge, overvoltage, overtemperature, fabrication defects, etc. A mechanical defect may e.g., include a mechanical defect of a MEMS element of the microphone. A mechanical defect of a MEMS element may include at least one of stiction, contamination, excessive shock (e.g., negative acceleration) or stress cause mechanical failure, material failure, etc.

Electronic and/or mechanical defects may cause a DC value or saturation. Accordingly, such defects may be detected by detecting at least one of a DC value or saturation. If a microphone chip may detect a fault (e.g., a DC value), the microphone chip may generate a DC output on the PDM interface. The DC output may be generated naturally or purposely. In a further example, defects may be detected based on a power-up self-test of the microphone chip which may be similar to a production chip self-test. Such self-test may be automatically performed in a microphone chip during a start-up phase of the microphone after power-up. The self-test may typically create a stimulus of the MEMS element internal to the microphone. A PDM output may ramp up to normal microphone output levels at a defined time after self-test. A PDM output may be default to mid-scale during self-test in order to avoid audio artifacts.

In one example, the non-acoustic data may include identification data of the first microphone 2A. For example, the identification data of the first microphone 2A may include information on a type or sort of the first microphone 2A. Alternatively, or additionally, the identification data of the first microphone 2A may include one or more technical specifications of the first microphone 2A.

At least one of the first microphone 2A or the second microphone 2B may be configured to be part of an automotive sensor. Automotive microphones or automotive sensors may be part of safety critical applications. In such case, it may be of interest to diagnose the microphones 2A, 2B of the application and report malfunctions to the controller 4. The methods described herein may provide a technical feature for automotive microphone sensors to transmit non-acoustic data of a first microphone (such as e.g., diagnostic and/or identification data) to the controller 4, for example based on a PDM interface. A data channel conventionally used for transmitting acoustic data of the second microphone may be used for transmitting non-acoustic data of the first microphone. The channel may not be available anymore for the second microphone, but no extra pins and/or wires may be required. Here, acoustic and non-acoustic data generated by the first microphone may be sent live and during operation via a same data line. The described technique for transmitting non-acoustic data may be superior to a technique in which a failure may be signaled only by interrupting communication.

Figure 5:
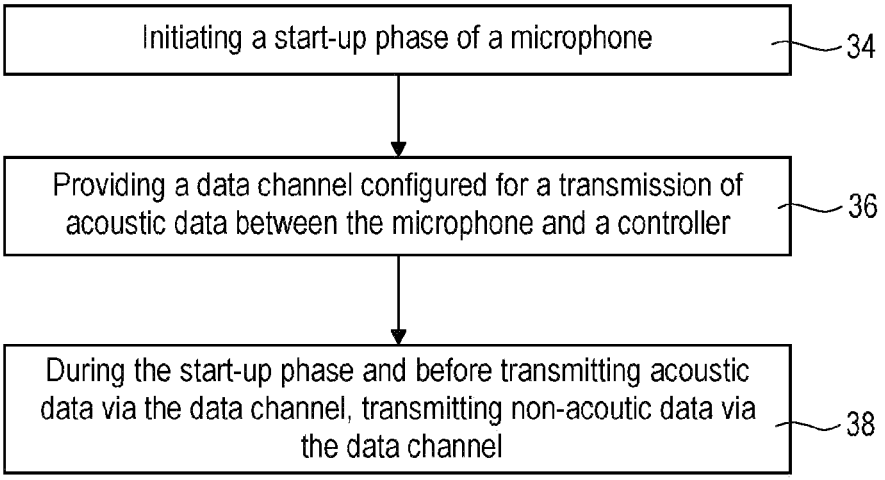
FIG. 5 illustrates a flowchart of a method in accordance with one or more embodiments.

The method of FIG. 5 is specified in a general manner in order to qualitatively specify aspects of the disclosure. The method may be extended by any of the aspects described in connection with the foregoing drawings. At 34, a start-up phase of a microphone may be initiated. At 36, a data channel configured for a transmission of acoustic data between the microphone and a controller may be provided. At 38, during the start-up phase and before transmitting acoustic data via the data channel, non-acoustic data may be transmitted via the data channel. For example, the method of FIG. 5 may be performed by corresponding components of the device 100 of FIG. 1.

Figure 6:
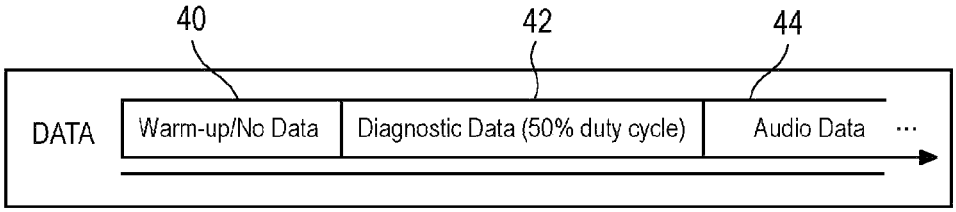
FIG. 6 schematically illustrates a timing diagram for transmitting non-acoustic data between a microphone and a controller in accordance with one or more embodiments.

FIG. 6 illustrates a timing diagram for transmitting non-acoustic data between a microphone and a controller in accordance with the disclosure. In particular, FIG. 6 shows usage of a data channel at a start-up of the microphone. The timing diagram may be read in connection with the method of FIG. 5. For example, the timing diagram may be valid for a data transmission between one of the microphones 2A, 2B and the controller 4 of FIG. 1.

The start-up phase of the microphone may include a warm-up phase 40 of the microphone. In this connection, the microphone may be connected to a supply voltage VDD, and the controller 4 may start sending clock signals to the microphone. The components of the microphone (circuitry, fuses, etc.) may be biased and the microphone may run through an internal start-up. During the warm-up phase 40, the microphone may be non-responsive. That is, the warm-up phase may be free of a data transmission between the microphone and the controller.

The start-up phase of the microphone may include a further phase 42 following the warm-up phase 40 which may be referred to as settling phase. In conventional devices and methods, the microphone may transmit a constant (or regular) data pattern during the settling phase 42, in particular a data pattern of alternating values of 1 and 0 (e.g., 10101010101010 . . . ). Such regular data pattern may have a duty cycle of 50 percent. In contrast to such conventional usage of the settling phase 42, non-acoustic data may be transmitted between the microphone and the controller during the settling phase 42 in the method of FIGS. 5 and 6. Here, the non-acoustic data may include a non-regular data pattern. For providing backwards compatibility, a duty cycle of the non-acoustic data may substantially equal a duty cycle of the conventional regular data pattern. Here, the duty cycle of the non-acoustic data may correspond to a total duty cycle, i.e., a duty cycle taking into account the non-acoustic data over the entire settling phase 42. In one specific case, a duty cycle of the non-acoustic data may be about 50 percent, similar to the duty cycle of the conventional regular data pattern. More general, a duty cycle of the non-acoustic data may be in a range from about 45 percent to about 55 percent, more particular from about 47 percent to about 53 percent, and even more particular from about 49 percent to about 51 percent. Similar to previous examples, a frequency of the non-acoustic data may be outside of the audible frequency range.

A transmission of the non-acoustic data according to FIG. 6 may be finished at the end of the settling phase 42. Acoustic data generated by the microphone may then be transmitted during a further phase 44 following the settling phase 42. According to FIGS. 5 and 6 a transmission of acoustic data may be limited to the start-up phase, more particular to the settling phase 42, of the microphone. In comparison to the method of FIGS. 3 and 4, a second data channel may remain free for usage of a second microphone.

Figure 7:
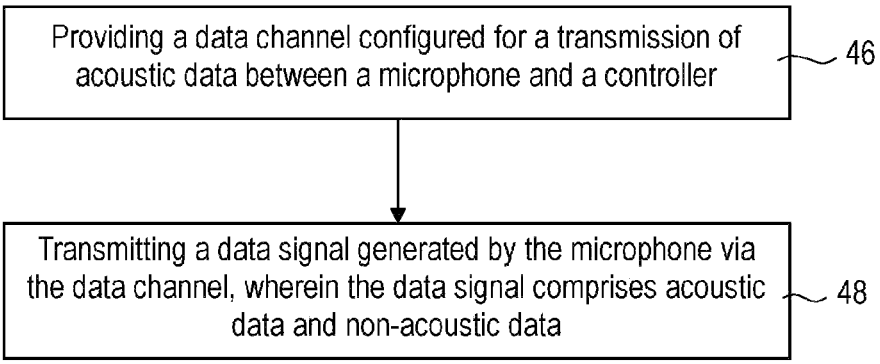
FIG. 7 illustrates a flowchart of a method in accordance with one or more embodiments.

The method of FIG. 7 is specified in a general manner in order to qualitatively specify aspects of the disclosure. The method may be extended by any of the aspects described in connection with the foregoing drawings. At 46, a data channel configured for a transmission of acoustic data between a microphone and a controller may be provided. At 48, a data signal generated by the microphone may be transmitted via the data channel, wherein the data signal may include acoustic data and non-acoustic data. For example, the method of FIG. 7 may be performed by corresponding components of the device 100 of FIG. 1.

Figure 8:
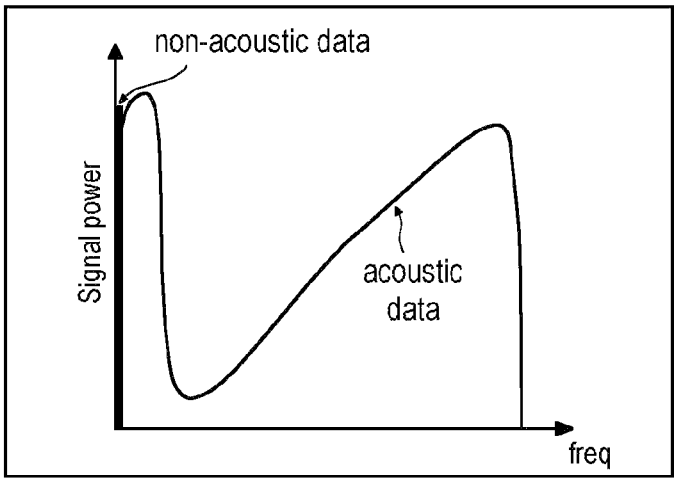
FIG. 8 schematically illustrates a frequency dependency of acoustic data and non-acoustic data transmitted between a microphone and a controller in accordance with one or more embodiments.

FIG. 8 illustrates a qualitative frequency dependency of acoustic data and non-acoustic data transmitted between a microphone and a controller in accordance with the disclosure. In one example, data having a frequency dependency as exemplarily shown in FIG. 8 may be transmitted according to the method of FIG. 7. The diagram of FIG. 8 may thus be read in connection with the method of FIG. 7.

In FIG. 8, a power of the acoustic signals and non-acoustic signals is plotted against the frequency of the signals. The acoustic data is indicated by a solid curve extending in the audible frequency range. In the example of FIG. 8, the audible data may include two local maxima. In further examples, the audible data may have an arbitrary different frequency dependency. The non-acoustic data may generally include one or multiple narrow frequency bands, wherein each of the frequency bands may have a frequency smaller than about 100 Hz or higher than about 8 kHz. In FIG. 8, an exemplary narrow frequency band is indicated by a thick bar at a frequency smaller than the audible frequency range. In a further example, the non-acoustic data may include a narrow frequency band having a frequency higher than the audible frequency range. In yet a further example, the non-acoustic data may include a first narrow frequency band having a frequency smaller than the audible frequency range and a second narrow frequency band having a frequency higher than the audible frequency range.

In particular, the acoustic data and non-acoustic data of FIG. 8 may be transmitted between the microphone and the controller during an operation. Here, the non-acoustic data may be encoded on top of the acoustic data as shown in FIG. 8. In this regard, the non-acoustic data may be based on or may be encoded by a DC shift which may be added to the acoustic data. Referring back to the frequency dependency of FIG. 8, a DC shift may correspond to a frequency of 0 Hz.

Figure 9:
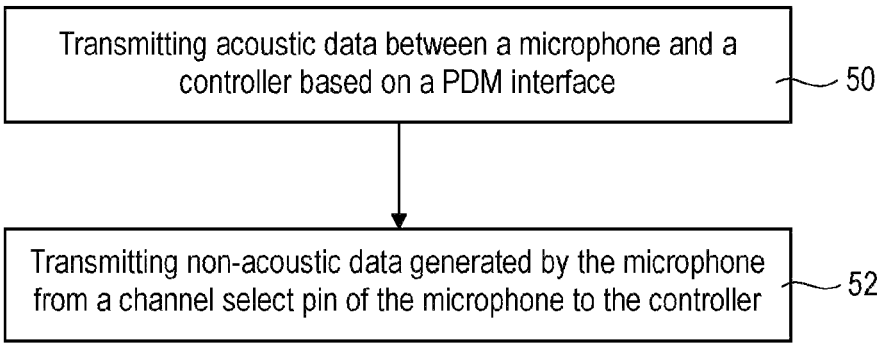
FIG. 9 illustrates a flowchart of a method in accordance with one or more embodiments.

The method of FIG. 9 is specified in a general manner in order to qualitatively specify aspects of the disclosure. The method may be extended by any of the aspects described in connection with the foregoing drawings. At 50, acoustic data may be transmitted between a microphone and a controller based on a PDM interface. At 52, non-acoustic data generated by the microphone may be transmitted from a channel select pin of the microphone to the controller. For example, the method of FIG. 9 may be performed by the device 1000 of FIG. 10 described in the following.

Figure 10:
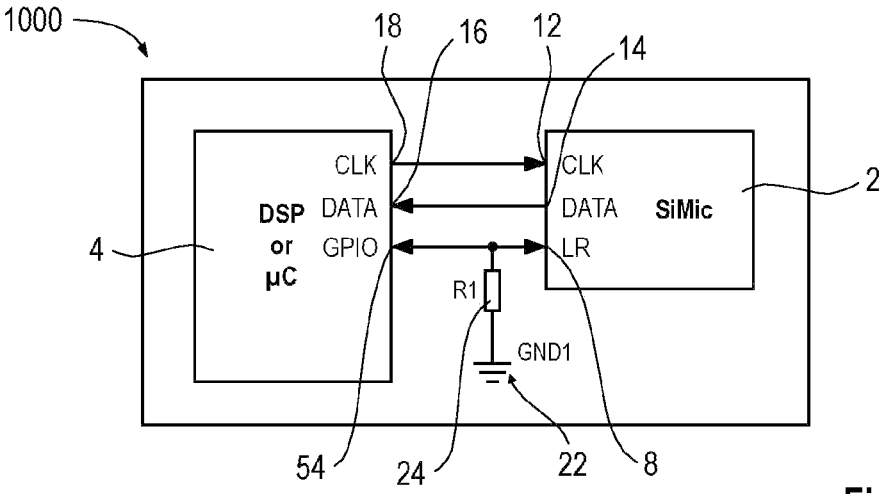
FIG. 10 schematically illustrates a device including a microphone and a controller in accordance with one or more embodiments.

The device 1000 of FIG. 10 may be at least partly similar to the device 100 of FIG. 1 and may be extended by any of the aspects described in connection with FIG. 1. The device 1000 may include a microphone 2 and a controller 4. The microphone 2 may include a clock pin 12, a data pin 14 and a channel select pin 8 corresponding to similar pins of FIG. 1. The controller 4 may include a clock pin 18 and a data pin 16 connected to the clock pin 12 and the data pin 14 of the microphone 2, respectively. In addition, the controller 4 may include a General Purpose Input Output (GPIO) pin 54 connected to the channel select pin 8 of the microphone 2. The device 1000 may further include a resistor 24 (see R1) and a ground potential 22 (see GND1).

The connection and communication between the microphone 2 and the controller 4 may particularly be based on a PDM interface as e.g., described in connection with FIG. 1. Non-acoustic data generated by the microphone 2 may be transmitted from the channel select pin 8 of the microphone 2 to the GPIO pin 54 of the controller 4. For example, the non-acoustic data may be transmitted during an operation of the device 1000. Alternatively, or additionally, the non-acoustic data may be transmitted during a start-up phase of the microphone 2 as e.g., described in connection with FIGS. 5 and 6.

In conventional devices, the channel select pin 8 may only be used as an input pin of the microphone 2. In contrast to this, the device 1000 of FIG. 10 provides a usage of the channel select pin 8 as an output pin, in particular for transmitting non-acoustic data to the controller 4. Referring back to FIG. 1, the LR pins 8A and 8B of the first microphone 2A and the second microphone 2B may be connected to the controller 4 in a similar fashion.

In one example, transmitting non-acoustic data and transmitting acoustic data between the microphone 2 and the controller 4 may both be based on a same clock signal which may be provided by the controller 4 (see CLK). As an alternative, transmitting the non-acoustic data may be based on a Manchester coding scheme or a phase encoding scheme. A Manchester code may be a line code in which an encoding of each data bit may be either low then high, or high then low, for an equal amount of time.

Various methods for transmitting non-acoustic-data are described herein. It is understood that the described methods may be combined, if reasonable and possible from a technical point of view. For example, a further method in accordance with the disclosure may be obtained by combining the methods of FIGS. 3 and 5. In such case, non-acoustic data may be transmitted during a start-up phase of the microphone as described in connection with FIGS. 5 and 6. In addition, further non-acoustic data may be transmitted during operation using a first data channel and a second data channel as described in connection with FIGS. 3 and 4.

EXAMPLES

In the following, methods for transmitting non-acoustic data between a microphone and a controller will be explained by means of examples.

Example 1 is a method, comprising: providing a first data channel configured for a transmission of acoustic data between a first microphone and a controller; providing a second data channel configured for a transmission of acoustic data between a second microphone and the controller; and transmitting non-acoustic data generated by the first microphone via the second data channel.

Example 2 is a method according to Example 1, wherein the non-acoustic data comprises at least one of diagnostic data of the first microphone or identification data of the first microphone.

Example 3 is a method according to Example 2, wherein the diagnostic data of the first microphone comprises information on at least one of an electronic defect of the first microphone or a mechanical defect of the first microphone.

Example 4 is a method according to Example 2 or 3, wherein the identification data of the first microphone comprises information on at least one of a type of the first microphone or a technical specification of the first microphone.

Example 5 is a method according to one of the preceding Examples, further comprising: using a clock signal, wherein a first one of the first data channel and the second data channel is based on a rising edge of the clock signal, and the second one of the first data channel and the second data channel is based on a falling edge of the clock signal.

Example 6 is a method according to one of the preceding Examples, wherein data of the first data channel and data of the second data channel is transmitted via a same data line.

Example 7 is a method according to one of the preceding Examples, wherein a transmission of data via the first data channel and a transmission of data via the second data channel is based on a PDM interface.

Example 8 is a method according to one of the preceding Examples, wherein at least one of the first microphone or the second microphone is configured to be part of an automotive sensor.

Example 9 is a method, comprising: initiating a start-up phase of a microphone; providing a data channel configured for a transmission of acoustic data between the microphone and a controller; and during the start-up phase and before transmitting acoustic data via the data channel, transmitting non-acoustic data via the data channel.

Example 10 is a method according to Example 9, wherein the non-acoustic data comprises at least one of diagnostic data of the microphone or identification data of the microphone.

Example 11 is a method according to Example 9 or 10, wherein the non-acoustic data comprises a non-regular data pattern.

Example 12 is a method according to one of Examples 9 to 11, wherein a frequency of the non-acoustic data is outside of the audible frequency range.

Example 13 is a method according to one of Examples 9 to 12, wherein the non-acoustic data has a duty cycle in a range from 45 percent to 55 percent.

Example 14 is a method according to one of Examples 9 to 13, wherein: the start-up phase of the microphone comprises a warm-up phase of the microphone, the warm-up phase is free of a data transmission, and the non-acoustic data is transmitted after the warm-up phase.

Example 15 is a method, comprising: providing a data channel configured for a transmission of acoustic data between a microphone and a controller; and transmitting a data signal generated by the microphone via the data channel, wherein the data signal comprises acoustic data and non-acoustic data.

Example 16 is a method according to Example 15, wherein the non-acoustic data comprises at least one of diagnostic data of the microphone or identification data of the microphone.

Example 17 is a method according to Example 15 or 16, wherein the non-acoustic data is based on a narrow frequency band smaller than 100 Hz or higher than 8 kHz.

Example 18 is a method according to one of Examples 15 to 17, wherein the non-acoustic data is based on a DC shift added to the acoustic data.

Example 19 is a method, comprising: transmitting acoustic data between a microphone and a controller based on a PDM interface; and transmitting non-acoustic data generated by the microphone from a channel select pin of the microphone to the controller.

Example 20 is a method according to Example 19, wherein the non-acoustic data is transmitted from the channel select pin of the microphone to a GPIO pin of the controller.

Example 21 is a method according to Example 19 or 20, wherein transmitting the non-acoustic data and transmitting the acoustic data is based on a same clock signal.

Example 22 is a method according to Example 19 or 20, wherein transmitting the non-acoustic data is based on a Manchester coding scheme.

While this disclosure has been described with reference to illustrative embodiments, this description is not intended to be construed in a limiting sense. Various modifications and combinations of the illustrative embodiments, as well as other embodiments of the disclosure, will be apparent to persons skilled in the art upon reference of the description. It is therefore intended that the appended claims encompass any such modifications or embodiments.

What is claimed is:

1. A method, comprising:

providing a first data channel configured for a first transmission of acoustic data between a first microphone and a controller;

providing a second data channel configured for a second transmission of acoustic data between a second microphone and the controller, wherein the first data channel and the second data channel are configured to be provided on a same data line; and transmitting non-acoustic data generated by the first microphone via the second data channel.

2. The method of claim 1, wherein the non-acoustic data comprises at least one of diagnostic data of the first microphone or identification data of the first microphone.

3. The method of claim 2, wherein the diagnostic data of the first microphone comprises information on at least one of an electronic defect of the first microphone or a mechanical defect of the first microphone.

4. The method of claim 2, wherein the identification data of the first microphone comprises information on at least one of a type of the first microphone or a technical specification of the first microphone.

5. The method of claim 1, further comprising:

using a clock signal, wherein a first one of the first data channel and the second data channel is based on a rising edge of the clock signal, and the second one of the first data channel and the second data channel is based on a falling edge of the clock signal such that:

the first one of the first data channel and the second data channel is configured to transmit the acoustic data at rising edges, that include the rising edge, of the clock signal and the second one of the first data channel and the second data channel is configured to be set into a high-impedance state at the rising edges of the clock signal, and the second one of the first data channel and the second data channel is configured to transmit the acoustic data at falling edges, that include the falling edge, of the clock signal and the first one of the first data channel and the second data channel is configured to be set into a high-impedance state at the falling edges of the clock signal.

6. The method of claim 1, wherein data of the first data channel and data of the second data channel is transmitted via the same data line.

7. The method of claim 1, wherein a transmission of data via the first data channel and a transmission of data via the second data channel is based on a pulse density modulation interface.

8. The method of claim 1, wherein at least one of the first microphone or the second microphone is configured to be part of an automotive sensor.

9. A method, comprising:

initiating a start-up phase of a first microphone;

providing a first data channel configured for transmission of first acoustic data between the first microphone and a controller;

providing a second data channel configured for transmission of second acoustic data between a second microphone and the controller, wherein the first data channel and the second data channel are configured to be provided on a same data line; and during the start-up phase and before transmitting the first acoustic data via the first data channel, transmitting non-acoustic data generated by the first microphone via the second data channel.

10. The method of claim 9, wherein the non-acoustic data comprises at least one of diagnostic data of the first microphone or identification data of the first microphone.

11. The method of claim 9, wherein the non-acoustic data comprises a non-regular data pattern.

12. The method of claim 9, wherein a frequency of the non-acoustic data is outside of an audible frequency range.

13. The method of claim 9, wherein the non-acoustic data has a duty cycle in a range from 45 percent to 55 percent.

14. The method of claim 9, wherein:

the start-up phase of the first microphone comprises a warm-up phase of the first microphone, the warm-up phase is free of a data transmission, and the non-acoustic data is transmitted after the warm-up phase.

15. A method, comprising:

providing a first data channel configured for transmission of first acoustic data between a first microphone and a controller;

providing a second data channel configured for transmission of second acoustic data between a second microphone and the controller, wherein the first data channel and the second data channel are configured to be provided on a same data line; and transmitting a non-acoustic data signal generated by the first microphone via the second data channel.

16. The method of claim 15, wherein the non-acoustic data comprises at least one of diagnostic data of the first microphone or identification data of the first microphone.

17. The method of claim 15, wherein the non-acoustic data is based on a narrow frequency band smaller than 100 Hz or higher than 8 kHz.

18. The method of claim 15, wherein the non-acoustic data is based on a DC shift added to the acoustic data.

19. A method, comprising:

transmitting first acoustic data between a first microphone and a controller based on a pulse density modulation interface via a first data channel;

transmitting second acoustic data between a second microphone and the controller via a second data channel, wherein the first data channel and the second data channel are configured to be provided on a same data line; and transmitting non-acoustic data generated by the first microphone from a channel select pin of the first microphone to the controller, via the second data channel.

20. The method of claim 19, wherein the non-acoustic data is transmitted from the channel select pin of the first microphone to a general purpose input output pin of the controller.

21. The method of claim 19, wherein transmitting the non-acoustic data and transmitting the first acoustic data is based on a same clock signal.

22. The method of claim 19, wherein transmitting the non-acoustic data is based on a Manchester coding scheme.

* * * * *